United States Patent [19]

Wild

[11] 3,940,771

[45] Feb. 24, 1976

[54] VARIABLE ANGLE SUPPORT APPARATUS

[75] Inventor: Charles E. Wild, Anna, Tex.

[73] Assignee: Rockwell International Corporation, El Segundo, Calif.

[22] Filed: Apr. 21, 1975

[21] Appl. No.: 569,916

[52] U.S. Cl. ..... 343/766; 343/882; 248/396

[51] Int. Cl.[2] ..... H01Q 1/08; H01Q 3/02

[58] Field of Search ..... 343/765, 766, 881, 882, 343/915; 248/396

[56] References Cited

UNITED STATES PATENTS 3,215,391 11/1965 Storm ..... 343/765

3,787,870 1/1974 Rocci ..... 343/765

*Primary Examiner*—Eli Lieberman

*Attorney, Agent, or Firm*—Bruce C. Lutz; Robert J. Crawford

[57] ABSTRACT

An adjustable support apparatus adapted primarily for antennas wherein most of the load is carried by pivotal rigid structural members and the drive members are subjected to a much smaller force. An embodiment is also described illustrating selferection principles.

8 Claims, 7 Drawing Figures

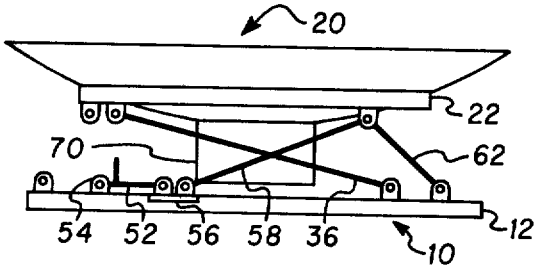
POSITION 1
STOW
FIG. 2
POSITION 2
SELF ERECTED
FIG. 3
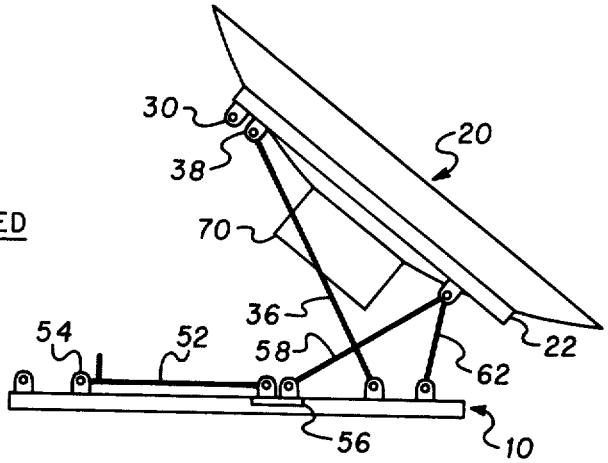
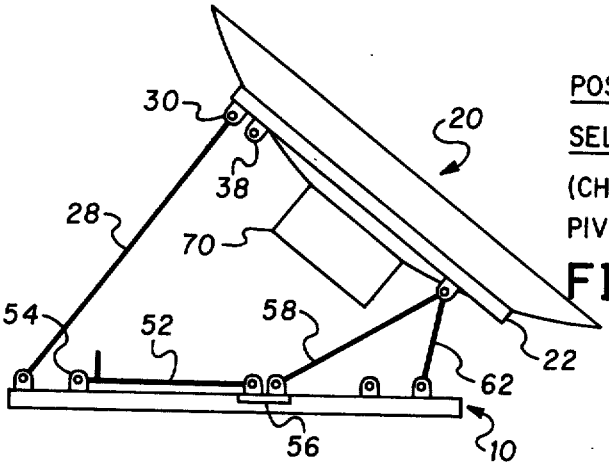
POSITION 3
SELF ERECTED
(CHANGE OVER TO
PIVOT MEMBERS)
FIG. 4
POSITION 4
OPERATING
FIG. 5
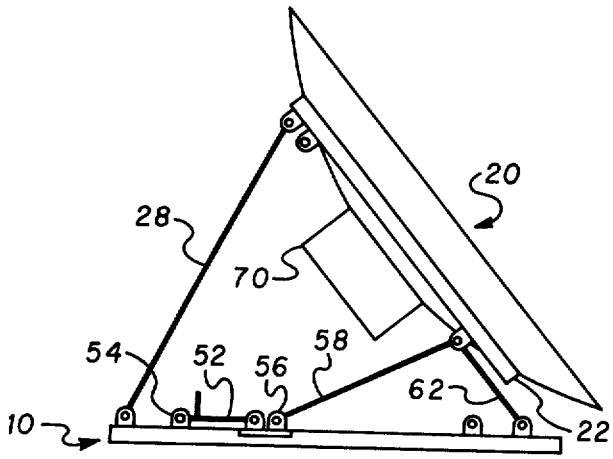

VARIABLE ANGLE SUPPORT APPARATUS

THE INVENTION

The present invention pertains generally to support apparatus and particularly to a device for erecting a support to an operating position and utilizing the same basic structure used for erecting to adjust the operating position of the support.

There have been many support mechanisms designed in the past. Many of these have been used for antenna positioners. However, all known prior art has suffered from one or more of the following. The apparatus was supported from the center for ease of ajustment and thus did not allow room for electronics adjacent the most desirable and balanced position which is at the center and was less stable for a given support apparatus weight. The apparatus providing the adjustment in position or boresight angle also provided the support thus causing the drive mechanism to be excessively heavy. The antenna was of such a nature that to obtain the design angle adjustment, separate apparatus had to be used to place it in a storage condition for transportation to a different area. The support and adjustment mechanism was so heavy that it created problems in attempting to transport the device from one area to another. The adjustment and support mechanism was complex in design and there was no interchangeability of parts thus creating a spare parts inventory problem.

The present mechanism is lightweight and uses a plurality of similar rigid members which are hinged at each end and which form triangles between the base and a point on the antenna support or load. The adjustment mechanism adjusts the configuration of two of the triangles both for initial erection purposes and for azimuth and altitude angles after erection. The rigid members of the triangular configurations carry most of the load so that the drive members may be of a minimum size. In one embodiment, the driven member is clamped to the base after final adjustment and thus there is no further strain on the drive member. The triangular member configurations are not limited to the support but are also used in providing stabilization against wind deflection.

In view of the above, it is an object of the invention to provide an improved support angle adjustment mechanism.

Other objects and advantages of the present invention may be ascertained from a reading of the specification and appended claims in conjunction with the drawings wherein:

FIGS. 2, 3, 4 and 5 illustrate the positions of the support triangles and the antenna as it is being raised from its stored or transportable position to the operating position;

DETAILED DESCRIPTION

Figure 1:
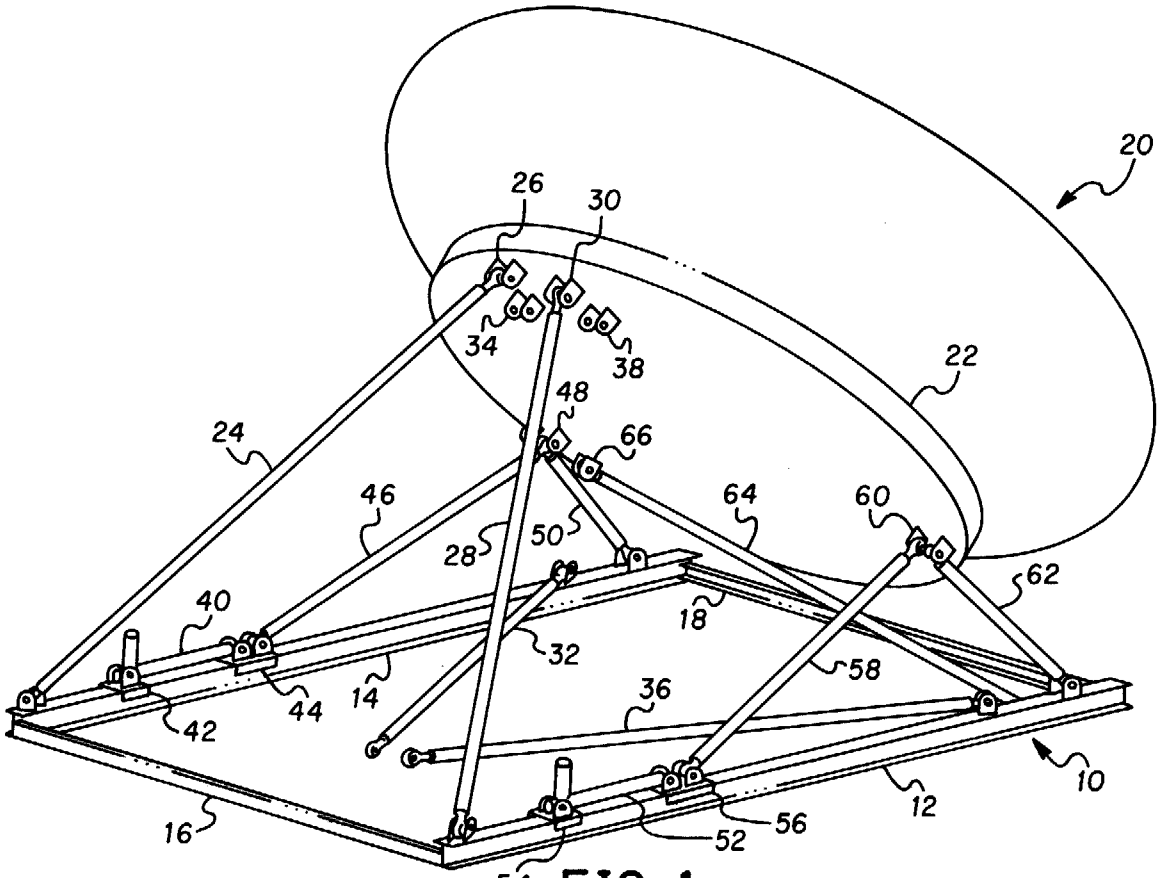
FIG. 1 is a representation of a preferred embodiment of the self-erecting and adjustment mechanism.

In FIG. 1, a base generally designated as 10 has a first I-beam 12 and a second I-beam 14 which are connected by cross-supports 16 and 18 and an antenna generally designated as 20 has a flat load bearing surface 22 with a plurality of mounting means attached thereto. A first rigid member 24 is connected between beam 14 and a mounting means 26 on surface 22. A second rigid member 28 is connected between I-beam 12 and a second mounting means 30. One of the members 24, 28 and a later defined member 64 must be length adjustable during azimuth adjustments. The members 24 and 28 are pivotally attached at both ends to their respective mounts. A rigid member or rod 32 is connected at one end to I-beam 14 and although laying in a horizontal position is designed to be connected to a further mounting means 34 adjacent mounting means 26. A rod 36 is connected at one end to beam 12 and is designed to be connected at the other end to a mounting means 38 adjacent mounting means 30. A drive member or adjustment means 40 is positioned between a pair of clamps 42 and 44 on I-beam 14. The clamp 44 is connected to one end of a rigid pivotal member 46 whose other end is connected to a mounting means 48 on the surface 22. A further rigid member 50 is connected between mounting means 48 and a mount on I-beam 14. A second adjustment means 52 is connected between a pair of clamps 54 and 56 on beam 12. A rigid member 58 is connected between the mounting means 56 and a mounting means 60 on the surface 22. A further rigid member 62 is connected between the mounting means 60 and the I-beam 12. A final rigid member 64 is connected between a mounting means 66 and a mount on I-beam 12. All of the rigid members (24, 28, 32, 36, 46, 50, 58, 62, and 64) are pivotally connected at each end to allow general flexibility of action. The electric mechanisms 40 and 52 are of the type which will vary in length upon an application of an electric signal to the means. Such a device can be purchased as a MiniPac Actuator under No. MPA-6405-18 from Dunn-Norton, a subsidiary of Amster Corporation of Charlotte, N.C.

The rods 24 and 28 in conjunction with the member 16 of base 10 form a triangle whose apex is generally located in the antenna section 20. The triangle is formed by the set of members will be termed the main pivot triangle. A further triangle is formed by the members 32 and 36 when attached to mounting means 34 and 38, respectively, and the base 10. This triangular configuration will be designated as the erection triangle. The leg 50 along with the leg 64 and the base 10 form a stabilization triangle with the apex connected to the antenna 20. As will be realized, the leg 62 and member 64 form a further triangle using the antenna 20 as the base and the common junction of 62 and 64 being the apex. Thus, there are in actuality two stabilization triangles but they use the member 64 as a common element. The members 46 and 50, in conjunction with the I-beam 14 form a first adjustment triangle while members 58 and 62 in conjunction with I-beam 12 form a second adjustment triangle.

In FIGS. 2–5 the same designations have been used as were used in FIG. 1 for identical members. However, there is an additional box 70 which contains the control electronics for use by the antenna.

Figure 6:
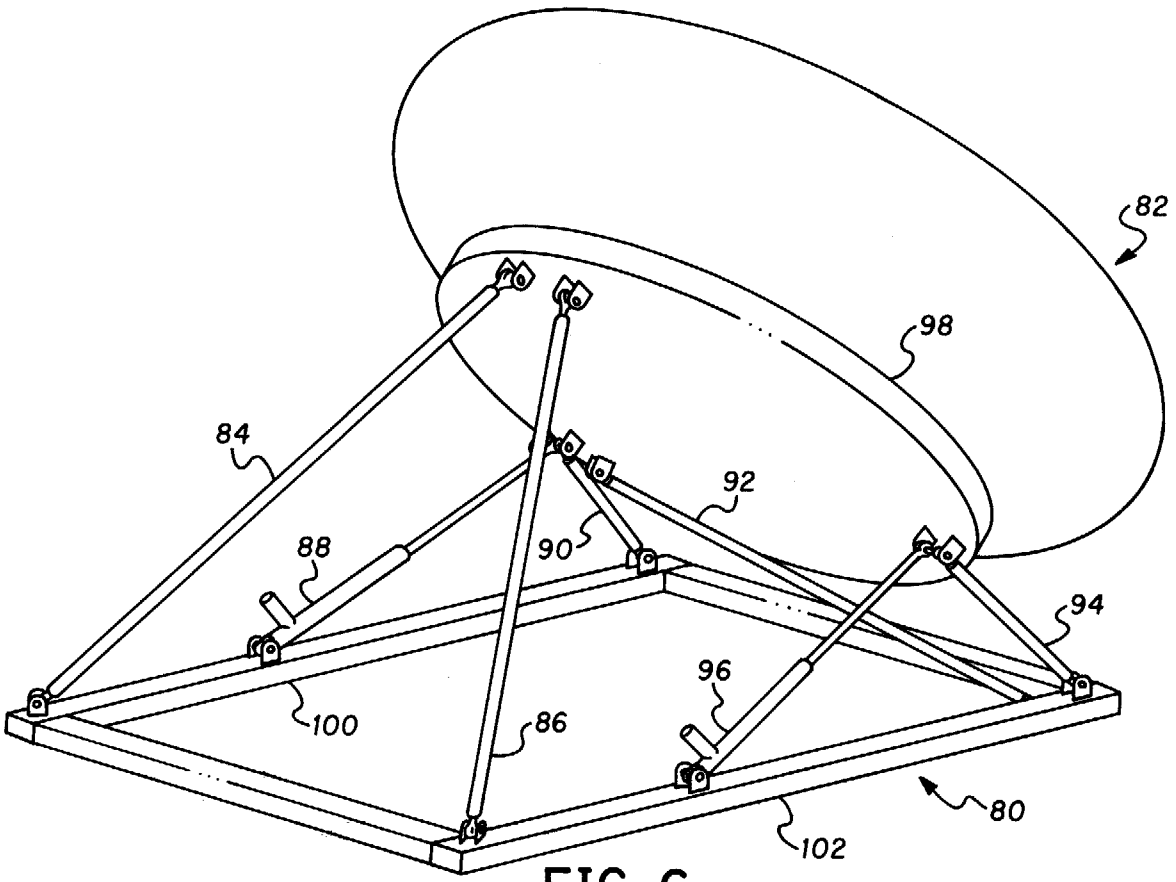
FIG. 6 illustrates a second embodiment of the invention wherein the drive mechanism is incorporated into the triangular support mechanisms.

In FIG. 6, a base 80 supports an antenna 82 similar to that of FIG. 1. The antenna 82 is supported in a fashion similar to that shown in FIG. 1 by supports 84, 86, 88, 90, 92, 94 and 96. The antenna of FIG. 6 is designed for permanent installation and thus can be erected by other means and does not need erection supports similar to 32 and 36 of FIG. 1. Further, since the design is substantially permanent, the driving members of FIG. 1 may be incorporated in the triangular adjustment means and comprise part of the triangular adjustment triangle as legs 88 and 96. These legs are connected between a load bearing surface 98 of antenna 82 and base members 100 and 102, respectively, of base 80. However, the members 84 and 86 along with base 80 still form a main pivot triangle. The base 80 along with members 90 and 92 form a stabilization triangle and the members 88 and 90 along with member 100 form a first adjustment triangle and members 94 and 96 along with member 102 form a second adjustment triangle in a manner similar to that described in connection with FIG. 1.

Figure 7:
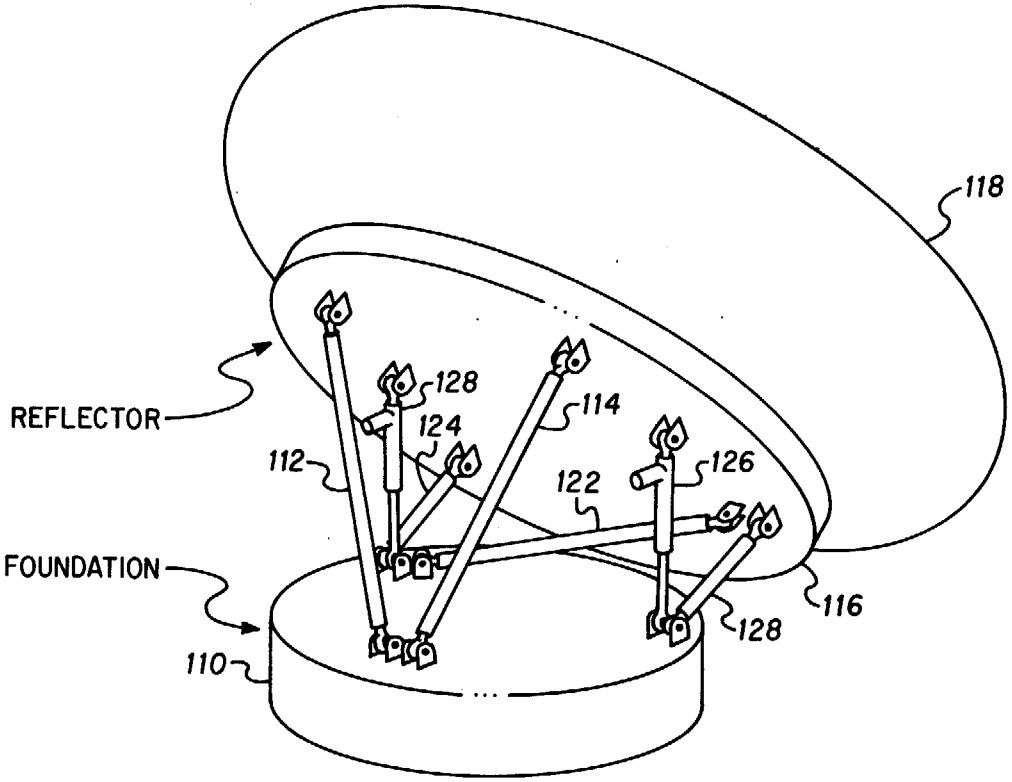
FIG. 7 illustrates a third embodiment of the invention wherein the bases of the triangles are reversed to illustrate that the concept is usable in a plurality of configurations.

In FIG. 7, a base generally designated as 110 has the vertex of a main pivot triangle comprising members 112 and 114 attached to a load bearing section 116 of an antenna generally designated as 118. The section 116 provides the base of the main pivot triangle for this support configuration. A member 120 in combination with a stabilization bar 122 forms a first stabilization triangular configuration with one side utilizing base 110 having a pivotal vertex or apex at the section 116. A further member 124, in combination with member 122 forms a second stabilization triangle. Adjustable member means 126 and 128 form first and second adjustment triangles along with respectively the members 128 and 124. As shown, the vertex of each of these triangles is attached to base 110 while the side comprises part of the section 116 of antenna 118.

As will be realized, the member 126 can be positioned in its attachment point to section 116 in a sliding configuration similar to that shown in FIG. 1 if so desired. Further, the erection members illustrated in FIG. 1 may also be added to FIG. 7 if so desired. Finally, while the section 116 forms one side of each of the various triangles except for one of the stabilization triangles, either base 110 or section 116 can form the side or vertex pivot point for each of the triangles and they can be interchanged so as to provide combinations of the configurations of FIGS. 1, 6 and 7.

OPERATION

Referring to the series of Figures from 2 to 5, it will be noted in FIG. 2 that the antenna is situated in a horizontal, stow or storage condition. By horizontal, it is meant that the load bearing portion 22 of antenna 20 is horizontal with respect to base 10. In this condition, the drive member 52 is in a fully retracted position and the pivot member 56 is rigidly clamped to frame member 12. In most instances, it would be desirable that member 54 also be ridigly clamped to 12. It is desirable to transport an antenna in this position as there is minimum wind resistance to provide forces which would tend to destroy the structure.

In FIG. 3, the drive member 52 is fully extended and has the antenna 20 at a substantial angle with respect to base 10. At this position, the members 28 and 24 can be connected to mounting points 30 and 26 and the members 36 and 32 can be removed from their mounting members 34 and 38. This changeover is illustrated in FIG. 4.

In FIG. 5, the drive member 52 is again retracted to continue altering the angle of the antenna 20 with respect to base 10. In most instances, the antenna will be designed such that leg or member 62 is substantially parallel with the supporting means 22 in an operational mode. The angle of adjustment of the antenna in elevation or attitude is about ±15° from the design angle in one working embodiment.

Reference will now be made to FIG. 1. It will be noted that if member 52 is extended without extending the drive member 40, the azimuth angle of the boresight of the antenna 20 will be affected. This will occur because the triangular configuration of 12, 58 and 62 is different from that of 14, 46 and 50. The azimuth direction of the antenna may be altered ± 15° from the fixed position of the base 10 in the above referenced embodiment.

In the above movement of member 40 without a corresponding movement of 52, the antenna 20 will attempt to pivot with respect to an axis formed by a line from 60 to one of 26 and 30 as restrained by stabilizer 64. If one of 24, 28 and 64 are designed to be movable or lockable in any position as desired, the antenna 20 can pivot along an axis from 60 to 26. Although 26 and 30 are shown separately for clarity, it may be desirable to combine the pivotal ends of members 24 and 28 as a single unit and thus have a single pivotal contact with base 22.

As stated above, some one or more members of FIG. 1 must be length adjustable to accomplish any major azimuth adjustments. This requirement occurs because if the length of the members 24, 28, 58 and 62 are held constant while attachment point 48 is moved upwardly and forwardly in an arc described by member 50, the member 64 will provide a restraining action in defining a different arc of allowable motion for attachment point 66.

While limited azimuth adjustments may be made without having any members length adjustable by moving 52 in an amount equal to and in a direction opposite that of 40, it is desirable that members 64 and/or 28 be adjustable for maximum usefulness of the adjustment apparatus.

The above comments not only apply specifically to FIG. 1, but also generally to the remaining figures.

While the illustrative erection of FIGS. 2–5 show the drive member 52 extending the full required distance when mounting means 54 is stationary, the drive members 52 can be of a much shorter extension and in one embodiment was of the design whereby it only extended 18''. In operation, the member 52 would be extended the full length with the clamps on mounting means 56 released. Upon full extension, the clamps in 44 and 56 are applied and the clamps in mounts 42 and 54 are released. Upon release of mounting means 42 and 54, the drive members 40 and 52 are retracted to move the mounting means 42 and 54 toward the antenna. Upon full retraction, the clamps and mounting means 42 and 54 are again applied and those in mounting means 44 and 56 are released so that further driving or positioning of the antenna 22 can be provided. Thus, the action is a walking-type action of total adjustment. The antennas involved are repositioned on a very infrequent basis and thus this type of adjustment is satisfactory. In fact, the adjustment is so seldom in some working applications that a drive mechanism such as 40 and 52 is not necessary and the adjustment can be made by the use of a long rod used as a lever to pry the mounting means 44 and 56 in the desired direction both for erection and for final positioning. Additional members would be necessary for the bars or levers to operate against in the prying operation. However, these have not been shown.

As previously mentioned, the drive members in this embodiment are subjected to much lower strain than has occurred in prior art designs. One embodiment of the invention in a static condition subjected members 24 and 28 to static compressive forces of 93 pounds with members 46 and 58 being subjected to 65 pounds and members 50 and 62 being subjected to 316 pounds. The cross-stabilizer member 64 was not subjected to any force. This loading occurred with the antenna looking at an angle of 40° with respect to a horizontal reference. In this configuration, the main pivot member arms 24 and 28 were approximately 128 inches, the legs 50 and 62 were approximately 36 inches and the members 46 and 58 were approximately 63 inches. The drive members 40 and 52 under these conditions were each subjected to only 54 pounds for further adjustments. However, during normal operating conditions with no adjustments, the mounting means 44 and 56 are clamped permanently in place and no further stress is applied to the drive members 40 and 52. The embodiment of FIG. 6 where the drive members 88 and 96 are part of the support mechanism, do not have this last advantage but it will be noted that they still have substantially less force applied thereto than do the remaining support members.

The removal of stresses from the drive members is even more important during high loading conditions such as would occur with a high wind. If the same antenna as referenced above were subjected at the indicated angle to a 60-mile wind head-on in a horizontal direction, the loading in the main pivot members is increased from 93 to 645 pounds, the stress in the adjustment members 46 and 58 is increased from 65 to 810 pounds and the compressive forces in members 50 and 62 is decreased from 316 to 266 pounds. Again, assuming that the wind is head-on there would be no loading on the stabilizer member 64. If the mounting means 44 and 56 were not securely clamped in place, the drive members 40 and 52 would each be subjected to forces of 680 pounds as opposed to the previous force of 52 pounds. Thus, in areas having high wind conditions, the removal of strain from movable members 40 and 52 is extremely important. The use of lower force movable members is not only a significant cost item, but substantially lowers the weight involved from the entire apparatus.

As previously indicated, the embodiment of FIG. 6 is designed for permanent installation without the requirement of self-erection and thus any clamping action would of necessity be limited to removing the stress from the drive motor itself by clamping the internal piston to the exterior frame or shell of the support means 88 and 96.

The erection operations of FIGS. 2–5 can be reversed for storing the antenna and transporting it to another site.

In view of the operational descriptions of the Figures above, no further explanation need be required for FIG. 7. It may be mentioned, however, that the configuration 7 provides more support points on the main antenna or reflector and specifically on section 116. With the support points placed further apart, section 116 need not be designed as sturdily as would be the case in FIGS. 1 and 6 for a given wind loading on the antenna. Further, with the configuration illustrated the foundation area, or base area 110, may be somewhat smaller than would be the case with the configurations of FIGS. 1 and 6. Further, as mentioned above, the fact that FIG. 7 illustrates that the vertexes of each of the triangles are connected to the base 110 is not controlling since the vertex for the main pivot triangle can be connected to one of the antenna and the base while the vertex of the adjustment triangles may be connected to the other of the antenna and the base.

While other modifications will occur to those skilled in the art, the present inventive concept is directed to the use of triangular support and pivot mechanisms wherein the leg of one or both of the two adjustment triangles is altered to change the elevation and azimuth angles of the load being supported. In the present illustrated embodiment, this load is an antenna. However, other loads may require the same adjustability. By using different length rods, the antenna can be used over a complete 90° operating range and can be adjusted over a considerable azimuth angle. However, the support design is lightweight and thus the apparatus can be easily mounted on a tractor-trailer and the trailer can be repositioned for different azimuth angles. Further, while the drive members have been illustrated as being hydraulic or electric, the drive members in the illustrated embodiment may be as simple as levers or jacks in a prying operation to provide the full adjustment of the boresight of the load.

In view of the above, it is my wish to be limited only by the scope of the appended claims.

I claim:

1. Support adjustment apparatus comprising, in combination:

base means having a generally horizontal reference;

load means to be supported and movable with respect to said base means and having a range of normal operating positions between 0° and 90° with respect to said base means;

first and second rigid members pivotally connected to both said base means and the portion of said load means closest to said base means when said load means is in its range of normal operating positions;

third rigid member means pivotally connected to said base means adjacent said first member means and pivotally connected to said load means adjacent said second member means to form, in combination with said load and base means, two substantially triangular and constant shape supporting configurations;

fourth and fifth rigid member means pivotally connected to said base means and to said load means, in an area removed from said first and second members, to form, in combination with one of said load means and said base means, a substantially triangular and constant shape supporting configuration while said load means is in its range of normal operating positions;

sixth and seventh member means pivotally connected to said base means and pivotally connected adjacent respectively said first and second members to form alterable triangular configurations between the associated members and one of said load means and said base means; and means for adjusting said sixth and seventh members to change the alterable triangular configurations and simultaneously change the operating position of said load means with respect to said base means.

2. Apparatus as claimed in claim 1 wherein:

said means for adjusting comprises means for adjusting the length of said sixth and seventh members.

3. Apparatus as claimed in claim 1 wherein:

said means for adjusting comprises means for adjusting the position of pivotal connection of said sixth and seventh means at the ends thereof which are remote from the first and second members, respectively.

4. Apparatus as claimed in claim 1 comprising in addition:

eighth and ninth rigid members pivotally connected to said base means, and means for connecting said eighth and ninth members to said load means, adjacent the connection thereto for said fourth and fifth members for lowering said load means to a substantially horizontal transportable position.

5. Apparatus for adjustably supporting a load in different positions using triangular support sections, comprising in combination:

base means situated in a generally horizontal position;

load means;

stabilizer triangular support means having a side pivotally attached to said base means and a vertex pivotally attached to said load means;

main pivot triangular support means having a side pivotally attached to one of said load means and said base means and a vertex pivotally attached to the other said load means and said base means;

first and second driving triangular support means each having a side pivotally attached to one of said load means and said base means and a vertex pivotally attached to the other of said load means and said base means; and adjusting means for altering to length of one side of each of said first and second driving triangular support means for adjusting the orientation of said load means with respect to said base means.

6. Apparatus as claimed in claim 5 comprising, in addition:

erection triangular support means having one side attached to said base means and a vertex attachable to said load means in substitution for the attachment thereto of said main pivot means during erection of said load means to an operational position.

7. Apparatus for erecting a load from a substantially horizontal storage position to an operating position comprising, in combination:

base means;

load means for storage in a position generally parallel with said base means and for operating in a position approaching perpendicular with respect to said base means;

stabilizer triangular support means having a side pivotally attached to said base means and a vertex pivotally attached to said load means;

main pivot triangular suport means having a side pivotally attached to said base means and a vertex attachable to said load means;

first and second driving triangular support means each having a side pivotally attached to said base means and a vertex pivotally attached to said load means;

adjusting means for altering to length of one leg of each of said first and second driving triangular support means for adjusting the orientation of said load means with respect to said base means;

erection triangular support means having one side attached to said base means and a vertex attachable to said load means; and means for attaching the vertex of each of said main pivot triangular support means and said erection triangular support means to said load means.

8. Apparatus as claimed in claim 7 comprising, in addition:

means for clamping said adjusting means in a given driven position to eliminate strain on the driving portion thereof during storage and operation.

* * * * *